US005709145A

United States Patent [19]

Shih

[11] Patent Number: 5,709,145

[45] Date of Patent: Jan. 20, 1998

[54] MATRIX PLATE HOLDER AND MATRIX PLATE FOR A HAND STAMP

[76] Inventor: Shiny Shih, No. 31, Lane 349, Chung Cheng S. Rd., Yung Kang City, Tainan Hsien, Taiwan

[21] Appl. No.: 807,894

[22] Filed: Feb. 26, 1997

[30] Foreign Application Priority Data

Jan. 13, 1997 [TW] Taiwan ..... 86200487

[51] Int. Cl.[6] ..... B41J 27/02

[52] U.S. Cl. ..... 101/109; 101/104; 101/103; 101/334

[58] Field of Search ..... 101/103, 104, 101/334, 109

[56] References Cited

U.S. PATENT DOCUMENTS

| | | | |
|---|---|---|---|
| 280,652 | 7/1883 | Moise | 101/334 |
| 1,025,019 | 4/1912 | Price | 101/334 |
| 2,079,080 | 5/1937 | Melind | 101/334 |
| 5,048,415 | 9/1991 | Shih | 101/333 |
| 5,105,738 | 4/1992 | Mehaffey | 101/103 |
| 5,152,223 | 10/1992 | Mairon | 101/104 |
| 5,623,875 | 4/1997 | Perets | 101/104 |

*Primary Examiner*—Edgar S. Burr
*Assistant Examiner*—Daniel J. Colilla
*Attorney, Agent, or Firm*—Bacon & Thomas

[57] ABSTRACT

A matrix plate and a matrix plate holder for a hand stamp are disclosed, wherein the matrix plate can be easily attached to and detached from the matrix plate holder. The matrix plate includes a mounting element defining a guide, a pair of arc-shaped fitting portions integrally formed on two lateral sides and a front of the guide, wherein each fitting portion defining an engaging tip, and a pair of manipulating wings integrally formed on two lateral sides of the fitting portions. The matrix plate holder includes a main board defining a cutout, two locating blocks located beside the cutout, wherein each locating block defines a locating recess and a connecting structure for connection to a casing of the handle stamp. When the matrix plate and the matrix holder are assembled, the guide is fittingly received in the cutout, the fitting portions are fixedly clamped between the locating blocks and the engaging tips are received in the locating recesses. By exerting a clamping force on the manipulating wings, the engagement between the locating blocks and the arc-shaped fitting portions is released.

3 Claims, 5 Drawing Sheets

MATRIX PLATE HOLDER AND MATRIX PLATE FOR A HAND STAMP

FIELD OF THE INVENTION

The present invention is related to a hand stamp, particularly to a matrix plate holder and a matrix plate for a hand stamp, wherein the matrix plate can be easily attached to and removed from the matrix plate holder.

BACKGROUND OF THE INVENTION

FIG. 6 is an exploded, perspective view showing a prior art hand stamp. The conventional hand stamp generally comprises a handle 50, a casing 60, a matrix plate holder 70 and a matrix plate 80, wherein the matrix plate 80 is attached to the matrix plate holder 70 by extending two hooks 71 of the matrix plate holder 70 through two rectangular holes 83 of the matrix plate 80 to engage therewith. Several recesses 81 are defined in a face of the matrix plate 80 for locating a plurality of matrixes 82 (only one being shown in FIG. 6). When a user wants to remove the matrix plate 80 from the matrix plate holder 70, one hand must be used to push the handle 50 downwardly to cause the matrix plate 80 and the matrix plate holder 70 to move away from the casing 60 a distance and then the other hand must be used to release the engagement between the hooks 71 and the matrix plate 80 by manipulating a pairs of pliers to laterally and inwardly move the hooks 71. Such an operation for releasing the engagement between the hooks 71 and the matrix plate 80 is not easy and must be very careful; otherwise, the ink in the matrix 82 may dirty the user who is performing the releasing operation.

The present invention therefore is aimed to provide an improved matrix plate holder and matrix plate for a hand stamp to mitigate and/or obviate the aforementioned problems.

SUMMARY OF THE INVENTION

An objective of the present invention is to provide a matrix plate holder and a matrix plate for a hand stamp, wherein the matrix plate can be easily attached to and removed from the matrix plate holder so that the matrix plate can be very easily replaced with another one to meet a different requirement of application.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
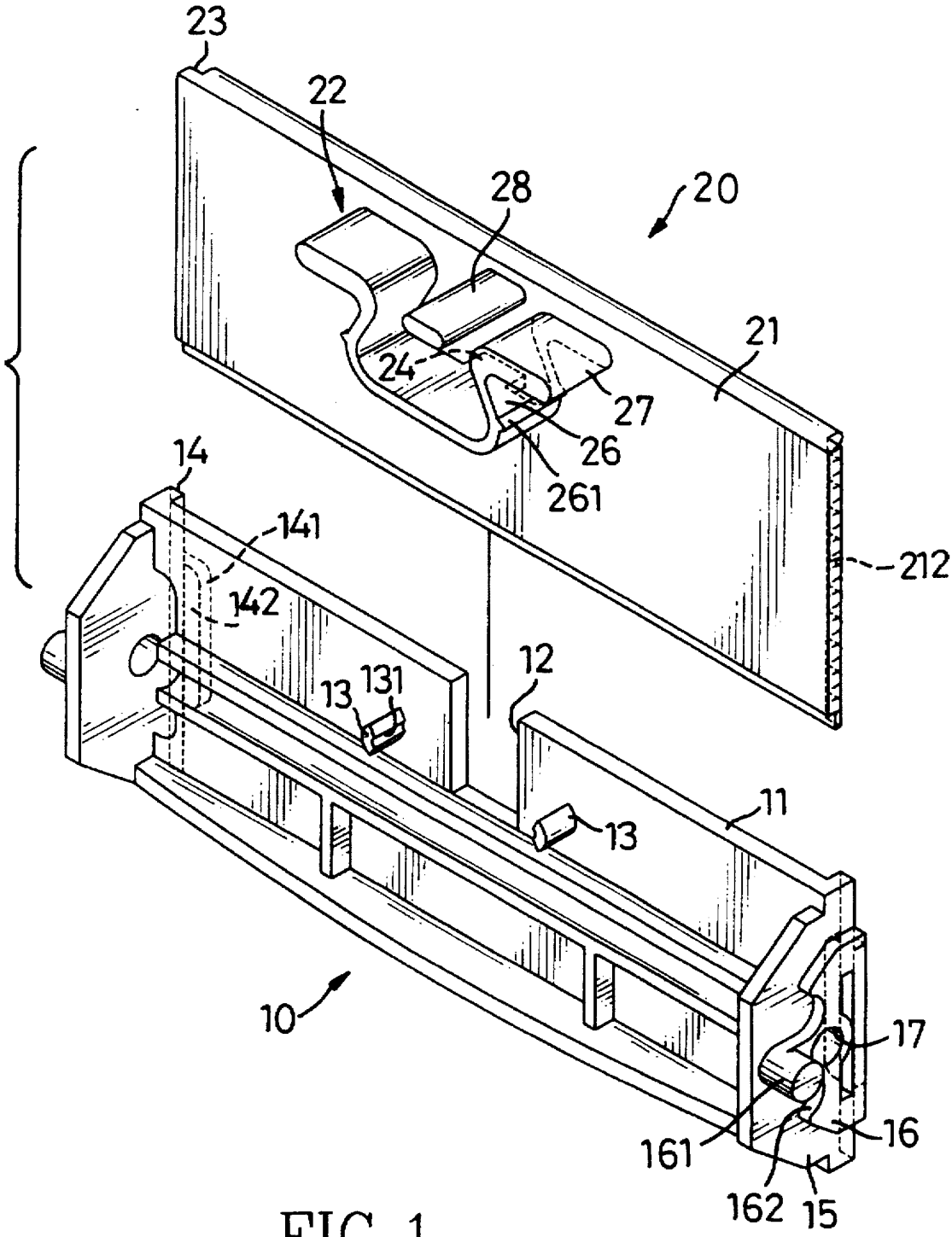
FIG. 1 is a perspective, exploded view showing a matrix plate and a matrix plate holder in accordance with the present invention.

Referring to FIGS. 1 to 4, a matrix plate holder 10 in accordance with the present invention is configured to have a main board 11. A cutout 12 is defined in a middle of the main board 11. Two locating blocks 13 each defining a locating recess 131 are formed on a front face of the main board 11 and located respectively on either side of the cutout 12. Two flanges 14 are extended rearwardly from two lateral ends of the main board 11. Two holding tabs 141 are respectively extended from the flanges 14 toward a center of the matrix plate holder 10. The holding tabs 141, the flanges 14 and the main board 11 cooperatively form mounting slots 142 therebetween.

A matrix plate 20 in accordance with the present invention includes a main plate 21, several recesses 212 defined in a rear side face of the main plate 21, a generally inverted Q-shaped, flexible mounting element 22 attached to a front side face of the main plate 21 and an auxiliary guide 28 also attached to the front side face of the main plate 21 and located above the mounting element 22 and between two manipulating wings 27 which will be detailedly discussed below.

The mounting element 22 is formed to have a guide 24 in connection with the main plate 21, two arc-shaped fitting portions 26 being respectively and integrally formed on two lateral sides of the guide 24 and located at a front thereof, two engaging tips 261 being defined on two lateral ends of the arc-shaped fitting portions 26, and the two manipulating wings 27 being integrally and laterally formed on a top of each of the arc-shaped fitting portions 26. Furthermore, two lateral projections 23 are defined on two lateral sides of the main plate 21. The auxiliary guide 28 is aligned with the guide 24 in the vertical direction, and, moreover, the auxiliary guide 28 has a width the same as that of the guide 24 and slightly smaller than that of the cutout 12 formed in the matrix plate holder 10. The guide 24 has a length which is slightly larger than a thickness of the main board 11 so that the arc-shaped fitting portions 26 and the manipulating wings 27 are spaced from the main plate 21 a distance slightly larger than the thickness of the main board 11 of the matrix plate holder 10.

Figure 2:
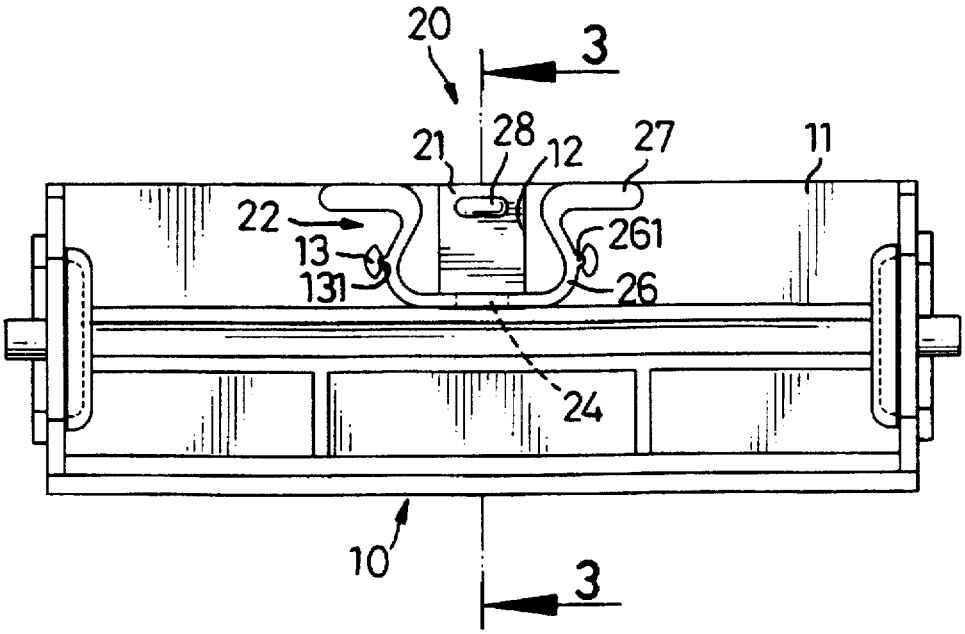
FIG. 2 is a front view showing that the matrix plate and the matrix plate holder are assembled together.
Figure 3:
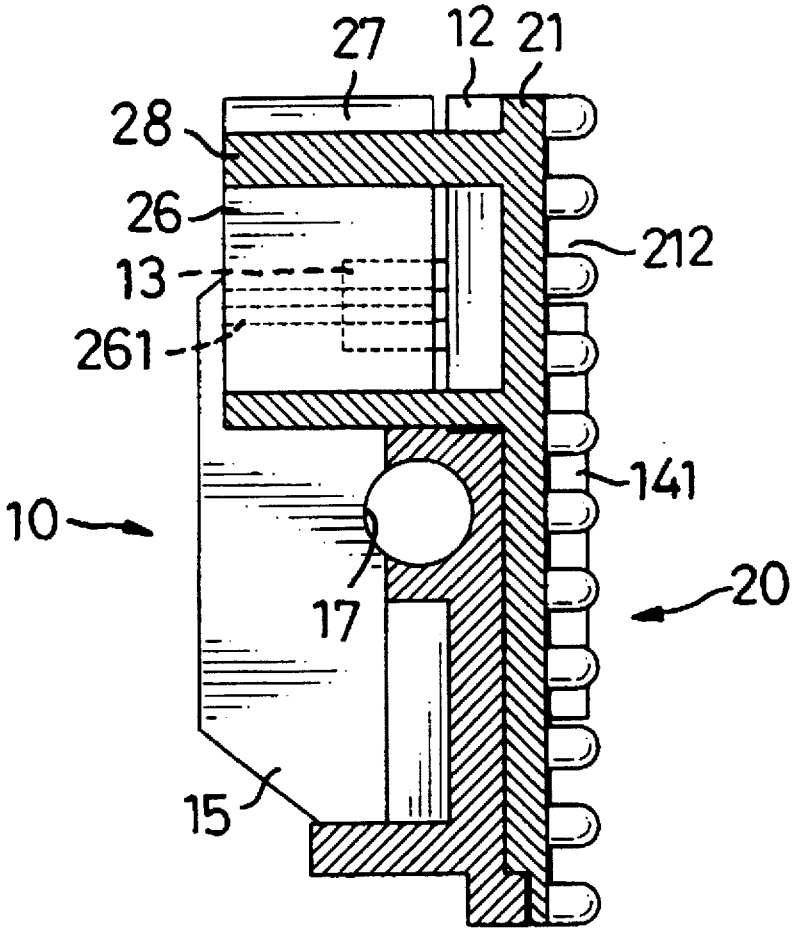
FIG. 3 is cross-sectional view taken from line 3—3 of FIG. 2.

When the matrix plate 20 and the matrix plate holder 10 are assembled together, the projections 23 are brought to extend into the mounting slots 142 while the guide 24 and the auxiliary guide 28 are brought to fittingly extend into the cutout 12 until the engaging tips 261 are fixedly received in the locating recesses 131, in which the arc-shaped fitting portions 26 are tightly clamped between the two locating blocks 13 so that matrix plate 20 and the matrix plate holder 10 are fixedly connected together, as shown by FIGS. 2 and 3.

Figure 4:
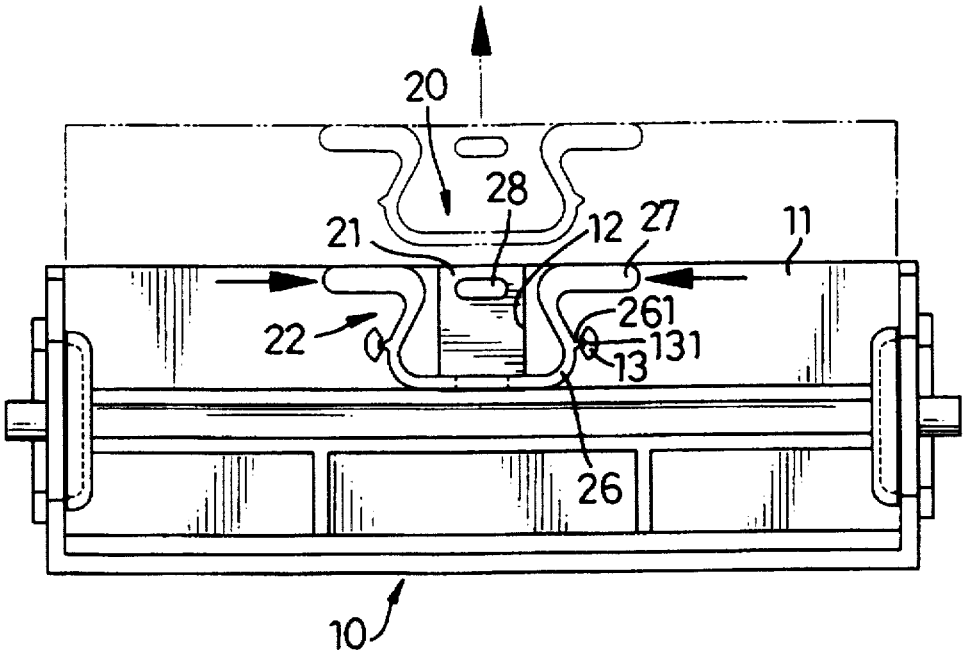
FIG. 4 is a view similar to FIG. 2, illustrating how the matrix plate is detached from the matrix plate holder.

When a user wants to detach the matrix plate 20 from the matrix plate holder 10 in order to change the matrix plate 20, all the user has to do is to use a thumb and a first finger to exert a clamping force on the manipulating wings 27 (as indicated by the opposite, horizontal arrows of FIG. 4) to release the engagement between the engaging tips 261 and the locating blocks 13 and then exert a pulling force on the matrix plate 20 relative to the matrix plate holder 10 (as indicated by the vertical arrow of FIG. 4), whereby the matrix plate 20 is detached from the matrix plate holder 10 (as indicated by phantom lines of FIG. 4).

Figure 6:
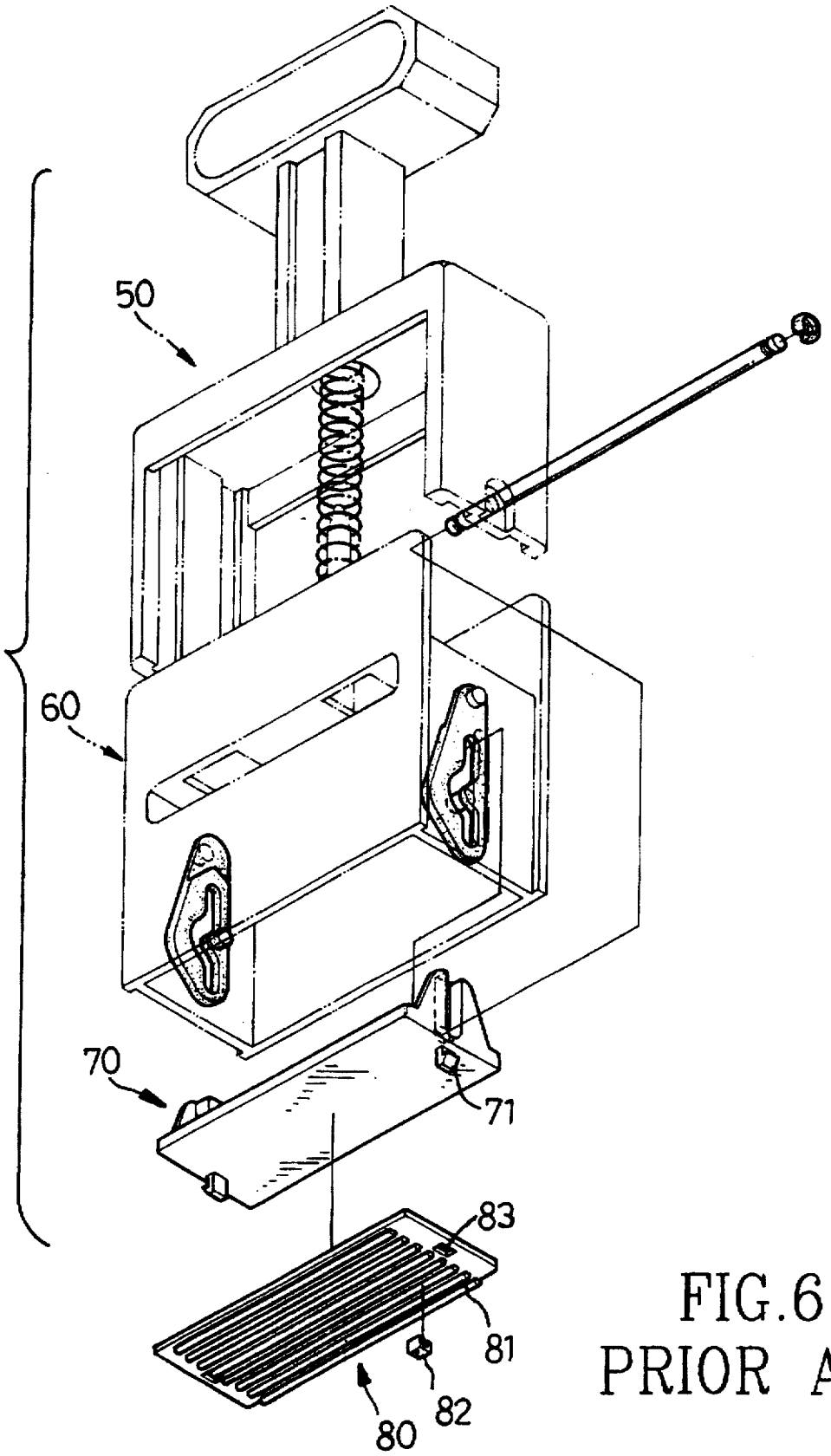
FIG.6 PRIOR ART
FIG. 6 is a perspective, exploded view showing a hand stamp in accordance with prior art.

From the above disclosures, it can be understood that in the present invention, the matrix plate 20 can be detached from the matrix plate holder 10 without the use of any tool and can be very easily attached to and detached from the matrix plate holder 10 so that to change the matrix plate 20 in accordance with the present invention is far more convenient and easier than the prior art shown by FIG. 6.

Figure 5:
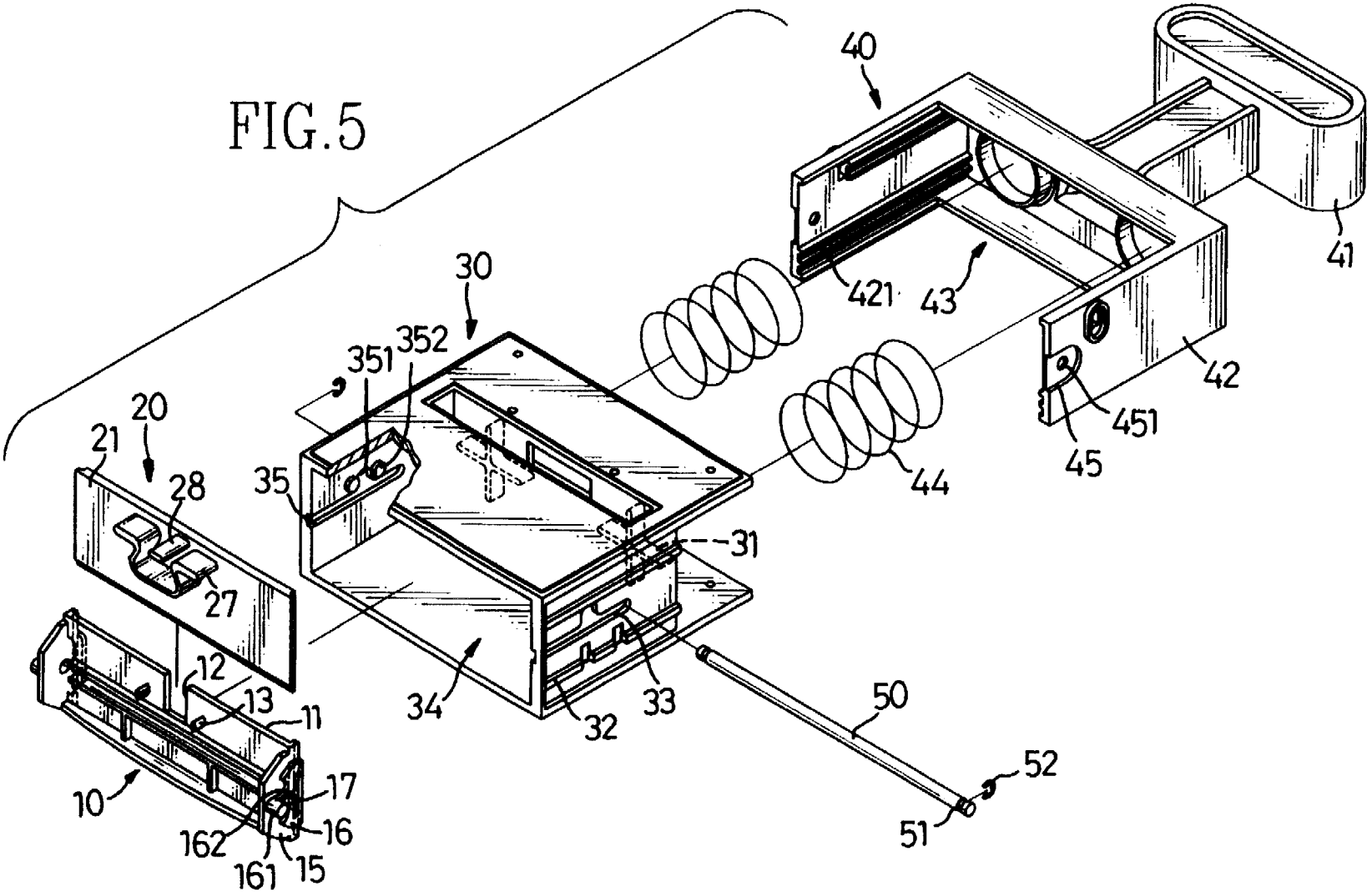
FIG. 5 is a perspective, exploded view showing a handle stamp to which the matrix plate and the matrix plate holder in accordance with the present invention are mounted.

FIG. 5 shows a hand stamp incorporating the matrix plate 20 and the matrix plate holder 10 in accordance with the present invention, wherein except for the above disclosed structure for connecting the matrix plate holder 10 and the matrix plate 20, the hand stamp has a structure substantially the same as that of U.S. patent application Ser. No. 08/651,861, which is applied by the same applicant of the present invention and incorporated herewith for reference.

A handle 40 has a substantially n-shaped lower structure and an upper hand grip portion 41, wherein the lower structure has a pair of sidewalls 42 and defines an internal-space 43 between the sidewalls 42 and an upper wall (not labeled). Each sidewall 42 defines a plurality of guiding grooves 421 in a longitudinal direction on an inside thereof. A pair of notches 45 are respectively defined at a bottom and on an outside of the sidewalls 42. A pair of holes 451 are respectively defined in the notches 45.

A casing 30 is movably received in the internal space 43 of the handle 40. The casing 30 defines an internal space 34. An ink reservoir (not shown) is disposed at an upper portion of the space 34. A plurality of flanges 32 are defined on an outside of each of a pair of sidewalls (not labeled) of the casing 30, wherein the flange 32 are received in the guiding grooves 421 of the sidewalls 42 of the handle 40. A slot 33 parallel to the flanges 32 is spaced between the flanges 32 on the sidewall, aligning with the hole 451 of the handle 40 so that a pin 50, in turn, may be inserted into the holes 451 and the slot 33 to engage the handle 40 with the casing 30. The pin 50 is allowed to move within the slot 33. Two parallel cross pieces 31 are disposed at a top of the space 34 so that two corresponding springs 44 may be compressed between the cross pieces 31 and the top wall of the lower structure of the handle 40 to enable the casing 30 to slideably move respective to the handle 40, while the respective movement of the handle 40 and the casing 30 is allowed till the pin 50 is retained at one end of the slot 33. In addition, a channel guide 35 parallel to the flange 32 on an outside of the sidewall of the casing 30 communicates with the slot 33 on an inside of the sidewall of the casing 30. Furthermore, the slot 33 defines a hog portion 351 at a midway thereof. The hog portion 351 is extended substantially perpendicularly to the slot 33. Two lugs 352 are disposed at an upper end and a lower end of the hog portions 351.

Also referring to FIG. 1, the main board 11 of the matrix plate holder 10 is formed to have two ears 15 respectively on two lateral sides thereof. The two ears 15 are perpendicular to the main board 11. Each of the ears 15 has a boss 161 formed thereon and received in the hog portion 351, a central hole 17 adjacent to the boss 161 and located near the main board 11 for passing by the pin 50, and a block stop 16 with two parallel notches 162 at a position adjacent to the central hole 17 for retaining the lugs 352 of the casing 30, whereby the matrix plate holder 10 is reversible to move in the space 34.

In assembly, firstly, the flanges 32 of the casing 30 are inserted into the guiding grooves 421 of the handle 40 and the springs 44 are provided and compressed between the handle 40 and the casing 30. The pin 50 then is inserted into the holes 451 of the handle 40, the slot 33 of the casing 30 and the central hole 17 of the matrix plate holder 10 to engage them together. Since the pin 50 has two ring grooves 51 respectively defined-at two ends thereof, two retaining rings 52 can be provided to fasten the pin 60 at the ring grooves 51 at an outside of the handle 40. It is noted that the two retaining rings 52 may be received in the two notches 45 of the handle 40 so as to prevent slippage.

The handle stamp in accordance with FIG. 5 has an advantage that it allows the matrix plate 20 to be reversed (i.e., the face of the matrix plate 20 on which the recesses 212 are defined and a matrix is attached being faced toward the ink box at an upper portion of the internal space 43), in order to prevent abrasion of the matrix.

Concerning the detailed operation of the hand stamp as illustrated by FIG. 5, please refer to the U.S. patent application Ser. No. 08/651,861.

Although in the preferred embodiment, the present invention is disclosed to be incorporated to a hand stamp in accordance with U.S. patent application Ser. No. 08/651,861, it can be understood by those skilled in the art that by suitably modifying the structure in connection with the ears 15, the matrix plate holder 10 together with the matrix plate 20 can be incorporated into other types of hand stamp.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A matrix plate and a matrix plate holder for a hand stamp, wherein the matrix plate comprises:

a main plate defining a plurality of recesses at a first side face thereof, said recesses are used to accommodate a matrix;

a flexible mounting element attached to a second side face of the main plate opposite to the first side face, said mounting element comprising:

a guide attached to the main plate;

a pair of arc-shaped fitting portions integrally formed on two lateral sides of the guide, each of said arc-shaped fitting portions defining an engaging tip; and a pair of manipulating wings integrally formed with the arc-shaped fitting portions; and the matrix plate holder comprises:

a main board defining a cutout;

two locating blocks located beside the cutout and each defining a locating recess; and means for connecting the matrix plate holder to a casing of the hand stamp; whereby, when the matrix plate and the matrix holder are assembled, the guide is fittingly received in the cutout, the fitting portions are fixedly clamped between the locating blocks and the engaging tips are received in the locating recesses so that the matrix plate and the matrix holder are fixedly connected together, and, by exerting a clamping force on the manipulating wings the engagement between the locating blocks and the arc-shaped fitting portions is released so that the matrix plate is detachable from the matrix plate holder.

2. The matrix plate and matrix plate holder in accordance with claim 1, wherein the matrix plate is formed with two projections on two lateral sides thereof and the matrix plate holder is formed with two mounting slots, and when the matrix plate and matrix holder are assembled, the projections are inserted into the mounting slots.

3. The matrix plate and matrix plate holder in accordance with claim 1, wherein the matrix plate further comprises an auxiliary guide in alignment with the guide and located between the two manipulating wings and when the matrix plate and the matrix plate holder are assembled, the auxiliary guide is also fittingly received in the cutout of the main board of the matrix plate holder.

* * * * *